United States Patent [19]

Elliott

[11] Patent Number: 4,477,236

[45] Date of Patent: Oct. 16, 1984

[54] LIQUID END STRUCTURE FOR RECIPROCATING PUMP

[76] Inventor: Robert E. Elliott, 2045 S. Holiday Hill Rd., Midland, Tex. 79703

[21] Appl. No.: 373,021

[22] Filed: Apr. 29, 1982

[51] Int. Cl.[3] ..... F04B 21/00; F04B 39/14

[52] U.S. Cl. ..... 417/454; 417/568

[58] Field of Search ..... 417/568, 454; 137/329.04, 512, 543.13, 543.19

[56] References Cited

U.S. PATENT DOCUMENTS

| | | | |
|---|---|---|---|
| 863,449 | 8/1907 | Richardson et al. | 137/329.04 |
| 1,619,950 | 3/1927 | Marty | 417/453 |
| 1,640,408 | 8/1927 | House | 137/329.04 |
| 3,009,423 | 11/1961 | Leissner | 417/269 |
| 3,030,978 | 4/1962 | Griffith et al. | 137/543.19 |
| 3,399,694 | 9/1968 | Vinson | 417/568 |
| 3,415,271 | 12/1968 | Maasberg et al. | 137/543.19 |

FOREIGN PATENT DOCUMENTS

| | | | |
|---|---|---|---|
| 349479 | 3/1922 | Fed. Rep. of Germany | 137/454.4 |
| 2711837 | 6/1978 | Fed. Rep. of Germany | 417/454 |
| 996280 | 7/1963 | United Kingdom | 417/568 |

*Primary Examiner*—William L. Freeh

*Attorney, Agent, or Firm*—Head, Johnson & Stevenson

[57] ABSTRACT

An improved liquid end for reciprocating pump which has a cylindrical valve chamber communicating with the pump inlet port and the pump outlet port, the valve chamber receiving an intake valve. A lower retainer holding the intake seat in fixed position, an outlet valve, and an upper retainer holding the outlet seat in fixed position and a closure member, all of these elements being slidably positioned in the valve chamber and each of the valves being made in such a way that the valve seat and the valve disc are each reversible, thereby effectively doubling the operating life of the wearing valve components.

9 Claims, 3 Drawing Figures

LIQUID END STRUCTURE FOR RECIPROCATING PUMP

BRIEF SUMMARY OF THE INVENTION

An improved liquid end for a reciprocating pump is provided for use with a pump body having a chamber and a plunger reciprocating therein. The improved liquid end is in the form of a body having a lower intake port and an upper discharge port. Intermediate these is a valve chamber communicating with the plunger chamber cylinder. Formed in the liquid end chamber is a vertical cylindrical valve bore which extends from the top surface. The cylindrical axis of the valve chamber is perpendicular to the axis of the pump plunger. The lower end of the valve chamber communicates with the intake port and the upper end communicates with the discharge port while the intermediate portion communicates with the plunger chamber. The valve chamber has a reduced internal diameter portion adjacent the lower end which provides a seating ledge.

An intake valve is positioned in the valve chamber in engagement with the seating ledge. A lower tubular cage retainer is slidably positioned within the valve chamber, the lower end thereof engaging the intake valve seat and serving to hold it in position. The lower cage retainer has a liquid opening in the sidewall thereof in alignment with the plunger axis, and the upper end of the lower cage retainer forms an annular seating surface. An exhaust valve is positioned in the valve chamber and rests on the upper seating surface of the lower cage retainer. An upper tubular retainer is positioned in the valve chamber and a lower end which engages the exhaust valve seat and holds it in position. The upper cage retainer has openings in its sidewall which is in alignment with the liquid end exhaust. A closure member is threadably positioned in the upper end of the valve chamber opening holding all elements in axial secure alignment.

Each of the valve assemblies consists of a valve seat, a valve stem guide, a valve disc, a spring, spring retainer and nut. The valve seat has sealing surfaces on the upper and lower sides. In the same manner the valve disc has upper and lower sealing surfaces. When the valve elements are worn, or damaged by erosion, they may be reversed from the pump and reversed forming, in effect, a new valve. By the provision of reversible valve seat faces and valve discs, the effective life of the valve elements is substantially doubled while at the same time immediate repair of the pumps is simplified, since all parts are already present.

DETAILED DESCRIPTION OF A PREFERRED EMBODIMENT

A common means of moving liquid, particularly where high pressures are required, is by means of a reciprocating plunger pump. The typical pump of this type as employed in industry at the present time is formed of the basic components of a pump powered and a liquid end. The pump body provides a crank arm arrangement and a bore in which crosshead (one or more) is reciprocated. At the end of the power end the liquid end is attached. The liquid end provides for connection to piping communicating with an intake port(s) and an exhaust port(s). The liquid end contains intake and exhaust valves. The valve assemblies are a critical element in the efficiency and durability of reciprocating pumps.

Most reciprocating pumps employed in industry today have valves which provide a valve seat and a closure disc which seals against the valve seat face when the valve is closed and which moves away from the valve seat when the valve opens on each stroke of the pump plunger. The valve seats and valve discs therefore take a substantial amount of abrasive punishment and are, therefore, often the first part of a pump to require replacement or repair. When pumps are employed to move liquids which are corrosive or abrasive, and particularly when high pressures are employed, the life expectancy of the valves may be relatively limited. The costs of shutting down a pump to replace and/or repair the valves therefore is often a primary expense in the operation of reciprocating pumps.

Conventional pump valve seats are either retained in place by heavy interference fits, or by taper-to-taper fits, or by clamping between the liquid end body and separate intake and exhaust manifolds. All of these conventional means of seat retention require very slow and difficult efforts to remove and replace or repair worn seats. Heavy force pullers are usually required to remove tapered seats, wedged in place by high pressure. In most pumps the valves, after becoming worn, must be discarded. The present invention represents a unique advancement of the state of the design of reciprocating pumps in that it provides an arrangement wherein the critical elements of a valve structure, that is, the valve seat and valve disc, may be reversed in such a manner that the useful life of each element is doubled. In addition, the means of servicing a pump which has become inoperative or inefficient because of valve wear can be expeditiously performed. The critical valve wearing elements for both intake and exhaust valves may be rapidly removed from the pump, reversed and reinstalled in an exceedingly short time. No taper fits are employed.

It is, therefore, an object of this invention to provide an improved liquid end structure for reciprocating plunger pump characterized by an arrangement wherein the intake and exhaust valves are formed of components which are reversible to thereby effectively double the useful life of such components, and to make such a change easy.

Figure 1:
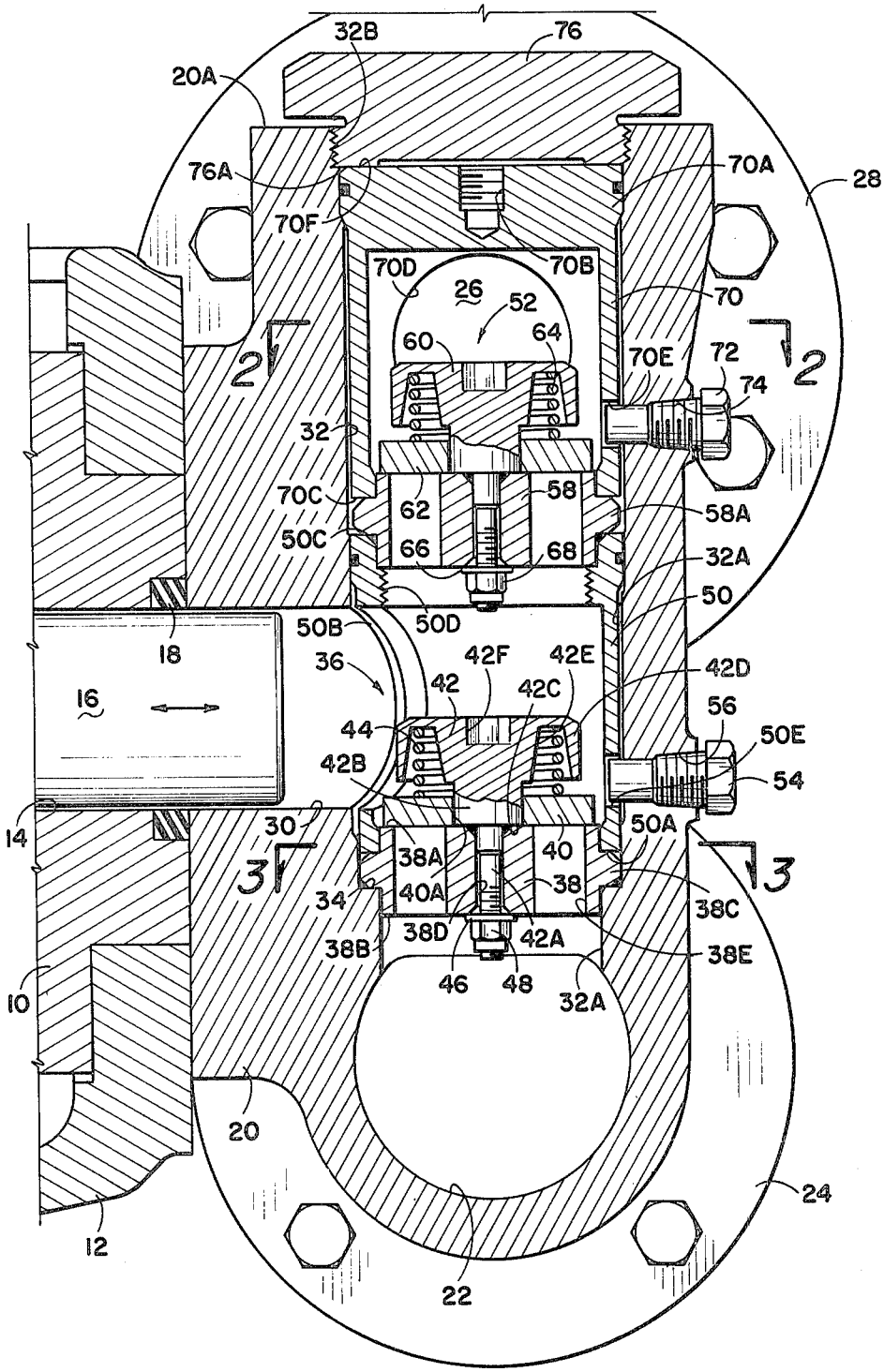
FIG. 1 is an elevational cross-sectional view of a liquid end body affixed to a reciprocating pump showing a preferred arrangement of this invention.

Referring first to FIG. 1, the elements 10 and 12 represent the stuffing box and power frame of a pump providing a sealing means 14 therein. Reciprocating within the seal is a plumger 16, the mechanism by which reciprocation is accomplished not being shown since it does not form a part of the invention. Suffice to say that the pump functions by the reciprocating action of the plunger, liquid being drawn into cylinder 14 when the piston is withdrawn and forced out of the cylinder when it is advanced. Packing 18 may be employed in conjunction with the cylinder by plunger 16 as desired, and the specific plunger packing or sealing arrangement is not part of the present invention.

Secured to the outer end of stuffing box 10, and power frame 12 is a liquid end body 20. The specific method of attachment of the liquid end body 20 to stuffing box 10, and power frame 12 is not shown since this is a known technique. While in FIG. 1 a single plunger 16 is shown, most reciprocating pumps are of multiple-plunger arrangements, and the liquid end body 20 may be arranged to receive and operate in conjunction with a single plunger or it may encompass the chambers required for employment of a plurality of plungers. The liquid end body 20 has an intake manifold 22 with a flange 24 illustrating the manner in which piping is connected to convey liquid to the intake port. In like manner, at the upper end of the body 20 is an outlet or exhaust manifold 26 with flange 28 employed to communicate the exhaust member to piping. Thus liquid is drawn into the pump through intake manifold 22 and expelled through exhaust manifold 26. Intermediate the ports 22 and 26 is a plunger chamber 30 which communicates with stuffing box 14 and, as illustrated, may receive the plunger 16 in its forwardmost advancement.

Formed in chamber 30 is a vertical elongated cylindrical valve chamber 32. Chamber 32 extends from the top end 20A of the liquid end. The lower end of chamber 32 communicates with inlet manifold 22 and adjacent the upper end of chamber 32, communication is provided with the exhaust port 26, while the plunger chamber 30 communicates with the opening 32 between the intake and exhaust valves.

At the lower end of valve chamber 32 the diameter is reduced at 32A to provide a seating ledge 34. Slidably positioned within the valve chamber 32 is an intake valve assembly generally indicated by the numeral 36. Making up the valve assembly 36 is a valve seat 38, a valve disc 40, a valve guide member 42, a spring 44, a washer 46, and a nut 48. The valve seat 38 is cylindrical and is preferably symmetrical about a horizontal plane, that is, the upper surface 38A and the lower surface 38B are identical. 25 The valve seat has an intermediate integral enlarged external diameter portion 38C which rests against the seating ledge 34. The upper surfaces 38A and lower surfaces 38B form valve sealing surfaces.

Secured to the valve seat is the valve guide stem 42. It has a lower reduced diameter portion 42A which is threaded at the lower end. This portion is received in axial opening 38D in the valve seat. The valve guide 42 is further defined by upper enlarged coaxial cylindrical portions 42B forming a ledge 42C which rests on the valve seat upper surface 38A.

The topmost portion of the valve guide stem has an enlarged integral bonnet portion 42D which has a circumferential inverted recess 42E therein which receives the compression spring 44. Formed in the upper end of the valve guide is recess 42F, a hexagonally shaped socket for wrench application while tightening the nut.

Reciprocally received on the valve guide is the valve disc 40 which has an opening 40A therein slightly larger than the external diameter of the valve guide cylindrical portion 42B. Spring 44 applies a compressive downward force on the valve disc. Liquid passages 38E formed in the valve seat permit liquid to flow therethrough when the valve disc 40 is raised off of the seat which occurs when the plunger 16 is retracted causing liquid to flow from inlet manifold 22 through openings 38E in the valve seat past the valve disc 40 and into the chamber 30. When the plunger 16 is moved forwardly, that is, towards the right, liquid pressure, combined with the action of spring 44, closes the disc 40 against seat 38 to block liquid from flowing in the opposite direction, forcing the liquid to flow upwardly in the valve chamber 32.

Slidably positioned within the valve chamber 32 is a suction or lower seat retainer cage member 50, the lower end of which 50A engages the valve seat external flange portion 38C to hold the intake valve seat 38 in secure position. Lower seat retainer 50 is cylindrical and of an external diameter slightly less than the internal diameter of the valve chamber It has an opening 50B in the sidewall thereof in axial alignment with plunger chamber 30. The upper end provides a ledge 50C for receiving and supporting an exhaust valve assembly generally indicated by the numeral 52. The tubular seat retainer 50 has, within its upper end, internal threads 50D providing means whereby it may be pulled from valve chamber 32. A small diameter opening 50E in the sidewall receives the inward end of an alignment plug 54. A threaded drain opening 56 in the liquid end body 20 receives plug 54 so that when it is fully inwardly advanced to project loosely into the alignment opening 50E, the correct positioning and alignment of seat retainer 50 is assured, while plugging the drain hole 56. This insures alignment of port 50B with plunger chamber 30.

The exhaust valve 52 is identical to the intake valve 36 and includes a valve seat 58, a valve guide 60, a valve disc 62, a spring 64, a washer 66, and a nut 68. The valve seat integral enlarged external diameter flange portion 58A rests on the lower retainer's upper end 50C.

A second or upper exhaust seat retainer 70 is tubular in the lower portion thereof and is closed at the upper end 70A and has a threaded opening 70B therein. The lower end 70C of the upper cage member engages the exhaust valve seat flange portion 58A to hold the exhaust valve in fixed position within the pump. One or two large diameter opening 70D in the sidewall of the upper seat retainer communicates with the exhaust manifold port 26. A smaller diameter opening 70E receives the inner end of a second alignment plug 72 positioned in a threaded drain opening 74 in the liquid end body 20. When drain plug 72 is inwardly positioned so that its inward end loosely projects into the opening 70E, proper alignment is in such of the upper cage 70 with exhaust port 26, while plugging drain hole 74.

The upper end of the valve chamber 32 is threaded at 32B and receives an externally threaded closure member 76. The lower end 76A of the closure member engages the upper end 70F of the upper seat retainer so that all components are retained securely. Thus the tightening of the closure member 76 tightens the valve assemblies 36 and 52 and retainers 50 and 70 in secure position relative to each other, and relative to plunger chamber 30.

Figure 2:
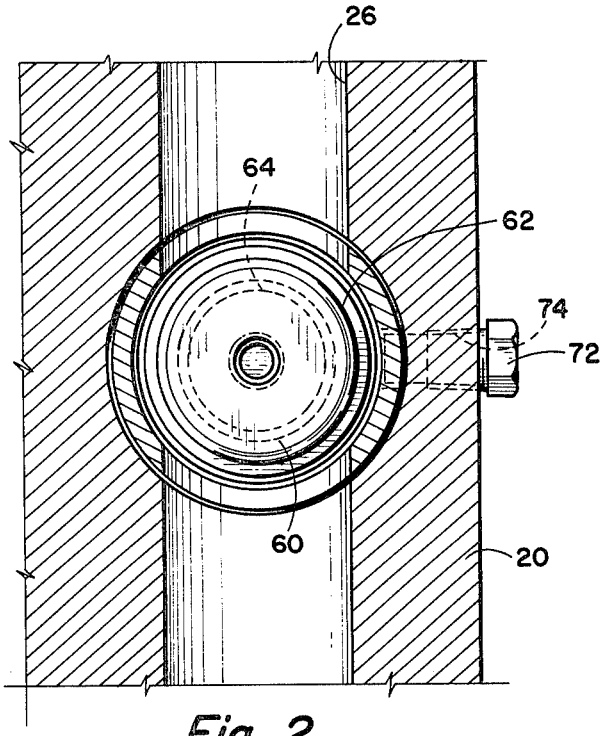
FIG. 2 is a cross-sectional view taken along the line 2—2 of FIG. 1.
Figure 3:
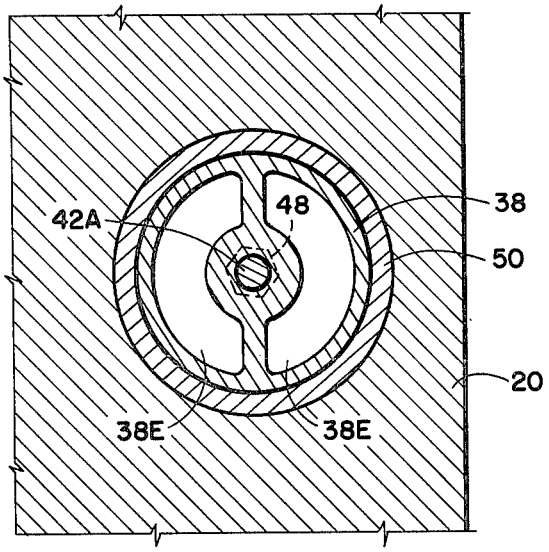
FIG. 3 is a cross-sectional view taken along the line 3—3 of FIG. 1.

FIGS. 2 and 3 show cross-sectional views of the liquid end showing more details of the arrangement of the valve structure.

When it is necessary to service the pump because of the wear on a valve, either intake valve 38 or exhaust valve 52, the operator removes cover 76. The threaded end of a puller (not shown) may be inserted into the threaded opening 70B in the upper cage 70 to facilitate its easy removal after the alignment plug 72 is first removed. Next, using only one's fingers the exhaust valve assembly 52 lifted out. Then a threaded puller element, also not shown, may be threaded into the threaded opening 50D in the lower retainer 50. It thereby may be pulled out of the valve structure opening 32 after alignment plug 54 is first backed out. Finally, using only one's fingers the lower valve assembly 36 may be removed. Thus all of the valve elements of the pump liquid end may be expeditiously pulled from the single valve opening. To repair intake valve 36, nut 48 is removed, allowing the the components of the valve to be disassembled. The valve seat 38 may be inverted or reversed if worn, and the valve disc 40 may likewise be inverted or reversed, if worn. The components may be reassembled and nut 48 placed back in position. Thus by this simple expediency, new valve seating surfaces for the intake valve 38 are so established. The same procedure may be employed for the exhaust valve 52. The intake valve, lower cage, exhaust valve, and upper cage may then be reinserted into position within the liquid end valve chamber 32. The alignment plugs 54 and 72 may be inserted, insuring the alignment of the seat retainers so that the openings in the sidewalls thereof are in correct orientation with the plunger port 30 and exhaust port 26. Cover 76 may be reinstalled, and the pump is thereby conveniently ready for reuse in a very short time and without requiring any replacement parts.

When the valves are worn after both sides of the valve seats and discs have been used, the valve seats and valve discs can be replaced, but each time they are replaced their useful life is double that of the normal replacement parts because of the opportunity to reverse these elements after wear takes place to thereby effectively double the useful lives of these components.

To ensure leakproof engagement of the various elements, seals such as in the form of "O-rings" are employed in various positions, some of which are illustrated in the drawings but are not identified by numbers since the use of seals such as O-rings for sealing purposes is well known in the pump industry.

The invention provides a method of reducing the costs of repair and replacement of valve elements in a positive displacement pump and in an arrangement wherein the easy removal, repair and/or replacement of valve wearing components can be accomplished expeditiously.

While the invention has been described with a certain degree of particularity, it is manifest that many changes may be made in the details of construction and the arrangement of components without departing from the spirit and scope of this disclosure. It is understood that the invention is not limited to the exemplified embodiments set forth herein but is to be limited only by the scope of the attached claim or claims, including the full range of equivalency to which each element thereof is entitled.

What is claimed is:

1. An improved liquid end valve structure for a reciprocating pump in which the pump has a body providing a chamber and a plunger reciprocating therein, the liquid end comprising:

a liquid end body having a lower liquid intake port, an upper exhaust port, and an intermediate plunger port between the intake and exhaust ports, the liquid end body being secured to the pump body with the plunger port in communication with the valve chamber, and the liquid end body being further defined by a vertical cylindrical valve chamber extending from the surface of the liquid end body, the cylindrical axis thereof being perpendicular the axis of the plunger, the lower end of the valve chamber communicating with said intake port, and the intermediate portion communicating with said plunger chamber, the valve chamber having a reduced internal diameter portion adjacent the lower end providing a seating ledge, the liquid end body having two spaced apart threaded alignment openings therein;

an intake valve positioned in said valve chamber in engagement with said seating ledge;

a lower tubular seat retainer of external diameter less than said valve chamber and being slidably received therein, the lower end of the lower seat retainer engaging said intake valve and serving to hold it in fixed position, the lower seat retainer having an opening in the sidewall thereof in coincidence with said plunger chamber, the upper end of the lower seat retainer forming an annular seating surface, and the lower seat retainer having an alignment opening therein spaced from said first mentioned opening;

an exhaust valve received in sealed engagement with said lower retainer upper end;

an upper tubular seat retainer of external diameter less than said valve chamber and slidably received therein, the lower end of the upper retainer engaging said exhaust valve to hold it in fixed position and having an opening in the sidewall thereof in coincidence with said outlet port, and the upper seat retainer having an alignment opening therein spaced from said first mentioned opening;

means to close the upper end of said valve chamber and to retain said upper seat retainer in secure engagement with said upper valve; and a threaded alignment plugs received in each said liquid end alignment openings and extending into said seat retainer alignment openings to insure proper orientation of said seat retainers.

2. The improved liquid end for a reciprocating pump according to claim 1 wherein each of said intake and exhaust valves comprises:

a cylindrical valve seat having an upper and lower side, and having an integral enlarged diameter portion of external diameter les than said valve chamber and engageable with a said seating ledge, both the upper and lower surface providing valve sealing surfaces and having an axial opening therethrough and liquid passageway opening therethrough spaced from said axial opening;

a cylinder valve disc member having an upper and lower sealing surface and having an axial opening therethrough;

a cylindrical valve guide stem member having a reduced diameter portion received and removably secured in said valve seat axial opening and having an upper enlarged diameter portion engaging the upper surface of said valve seat and slidably receiving said valve disc, the valve guide having an upper further enlarged diameter portion limiting the upward travel of said valve disc and providing spring retaining means; and compression spring means received between said valve guide stem upper portion and said valve disc to resiliently urge said valve disc into sealing engagement with said valve seat sealing surface.

3. The improved liquid end according to claim 2 wherein said valve disc is reversible, providing a sealing surface on each side thereof.

4. The improved liquid end according to claim 2 wherein said valve guide stem member upper enlarged diameter portion providing spring retaining means is in the form of an enlarged upper integral head portion having a circumferential lower spring receiving recess therein and having an internal hexagonal recess in the upper surface thereof, for wrenching purposes.

5. The improved liquid end for a reciprocating pump according to claim 1 wherein said valve seat is reversible, providing a sealing surface on each side thereof.

6. The improved liquid end according to claim 3 wherein said valve seat is symmetrical about a horizontal plane perpendicular the cylindrical axis of the seat.

7. An improved liquid end for a reciprocating pump according to claim 1 including means integral with each said seat retainers for extracting said seat retainers from said valve chamber.

8. The improved liquid end for a reciprocating pump according to claim 7 wherein said means integral with each of said lower and upper tubular seat retainers for extracting said seat retainers from said valve chamber includes internal threads in the upper ends thereof adaptable to receive an externally threaded puller.

9. The improved liquid end for a reciprocating pump according to claim 7 wherein each of said intake and exhaust valves comprises:

a cylindrical valve seat having an upper and lower surface, and having an integral enlarged diameter portion of external diameter less than said valve chamber and engageable with a said seating ledge, both the upper and lower surface providing valve sealing surfaces and having an axial opening therethrough and liquid passageway opening therethrough spaced from said axial opening;

a cylinder valve disc member having an upper and lower sealing surface and having an axial opening therethrough;

a cylindrical valve guide stem member having a reduced diameter portion received and removably secured in said valve seat axial opening and having an upper enlarged diameter portion engaging the upper surface of said valve seat and slideably receiving said valve disc, the valve guide having an upper further enlarged diameter portion limiting the upward travel of said valve disc and providing spring retaining means; and compression spring means received between said valve guide stem upper portion and said valve disc to resiliently urge said valve disc into sealing engagement with said valve seat sealing surface.

* * * * *